US007152536B2

(12) United States Patent
Hardy

(10) Patent No.: US 7,152,536 B2
(45) Date of Patent: Dec. 26, 2006

(54) PRODUCT MANAGEMENT DISPLAY SYSTEM

(75) Inventor: Stephen Neal Hardy, Wadsworth, OH (US)

(73) Assignee: RTC Industries, Inc., Rolling Meadows, IL (US)

( * ) Notice: Subject to any disclaimer, the term of this patent is extended or adjusted under 35 U.S.C. 154(b) by 352 days.

(21) Appl. No.: 10/772,134

(22) Filed: Feb. 3, 2004

(65) Prior Publication Data

US 2005/0166806 A1 Aug. 4, 2005

(51) Int. Cl.
*A47B 57/00* (2006.01)

(52) U.S. Cl. ..... 108/61; 211/59.3

(58) Field of Classification Search ..... 108/60, 108/61; 160/135; 211/59.3, 61, 184, 59, 211/2, 43, 11
See application file for complete search history.

(56) References Cited

U.S. PATENT DOCUMENTS

| | | | | |
|---|---|---|---|---|
| 2,085,479 | A | 6/1937 | Shaffer | |
| 2,110,299 | A | 3/1938 | Hinkle | |
| 2,111,496 | A | 3/1938 | Scriba | |
| 3,083,067 | A | 3/1963 | Vos | |
| 3,285,429 | A | 11/1966 | Propst | |
| 3,308,961 | A | 3/1967 | Chesley | |
| 3,308,964 | A * | 3/1967 | Pistone | 211/184 |
| 3,348,732 | A | 10/1967 | Schwarz | |
| 3,452,899 | A | 7/1969 | Libberton | |
| 3,652,154 | A | 3/1972 | Gebel | |
| 3,815,519 | A | 6/1974 | Meyer | |
| 3,830,169 | A | 8/1974 | Madey | |
| 3,868,021 | A | 2/1975 | Heinrich | |
| 4,300,693 | A | 11/1981 | Spamer | |
| 4,303,162 | A | 12/1981 | Suttles | |
| 4,331,243 | A | 5/1982 | Doll | |
| 4,467,927 | A | 8/1984 | Nathan | |
| 4,482,066 | A | 11/1984 | Dykstra | |
| 4,504,100 | A | 3/1985 | Chaumard | |
| 4,615,276 | A | 10/1986 | Garabedian | |
| 4,685,574 | A | 8/1987 | Young | |
| 4,706,821 | A | 11/1987 | Kohls | |
| 4,724,968 | A | 2/1988 | Wombacher | |
| 4,729,481 | A | 3/1988 | Hawkinson | |
| 4,730,741 | A | 3/1988 | Jackle | |
| 4,762,236 | A | 8/1988 | Jackle | |
| 4,830,201 | A | 5/1989 | Breslow | |
| 4,836,390 | A | 6/1989 | Polvere | |
| 4,907,707 | A | 3/1990 | Crum | |
| 4,934,645 | A | 6/1990 | Breslow | |
| 5,012,936 | A | 5/1991 | Crum | |
| 5,027,957 | A | 7/1991 | Skalski | |
| 5,111,942 | A | 5/1992 | Bernardin | |
| 5,123,546 | A | 6/1992 | Crum | |

(Continued)

FOREIGN PATENT DOCUMENTS

| | | |
|---|---|---|
| CH | 412 251 | 4/1966 |

(Continued)

*Primary Examiner*—Jose V. Chen
(74) *Attorney, Agent, or Firm*—Banner & Witcoff, Ltd.

(57) ABSTRACT

A product management display system for merchandising both wide and narrow product includes a unique pusher mechanism having an extendable pusher face. The pusher mechanism is mounted to a track on a base that is, in turn, mounted to a store shelf. The pusher face is transversely extendable relative the track and is extendable from a retracted position to one of several extended positions. The extended pusher face locates the product pushing surface behind the approximate center of the wider product, thereby greatly enhancing the pushing leverage on the product.

43 Claims, 4 Drawing Sheets

U.S. PATENT DOCUMENTS

| | | | | | |
|---|---|---|---|---|---|
| 5,161,702 | A | | 11/1992 | Skalski | |
| 5,178,258 | A | | 1/1993 | Smalley | |
| 5,190,186 | A | | 3/1993 | Yablans | |
| 5,265,738 | A | | 11/1993 | Yablans | |
| 5,341,945 | A | | 8/1994 | Gibson | |
| 5,366,099 | A | | 11/1994 | Schmid | |
| 5,390,802 | A | | 2/1995 | Pappagallo | |
| 5,450,969 | A | | 9/1995 | Johnson | |
| 5,464,105 | A | * | 11/1995 | Mandeltort | 211/184 |
| 5,469,976 | A | | 11/1995 | Burchell | |
| 5,542,552 | A | | 8/1996 | Yablans | |
| 5,562,217 | A | | 10/1996 | Salveson | |
| 5,634,564 | A | | 6/1997 | Spamer | |
| 5,673,801 | A | | 10/1997 | Markson | |
| 5,685,664 | A | | 11/1997 | Parham | |
| 5,738,019 | A | | 4/1998 | Parker | |
| 5,746,328 | A | | 5/1998 | Beeler | |
| 5,839,588 | A | | 11/1998 | Hawkinson | |
| 6,041,720 | A | | 3/2000 | Hardy | |
| 6,142,317 | A | | 11/2000 | Merl | |
| 6,655,536 | B1 | * | 12/2003 | Jo et al. | 211/59.3 |
| 6,866,156 | B1 | * | 3/2005 | Nagel et al. | 211/59.3 |
| 6,964,235 | B1 | * | 11/2005 | Hardy | 108/61 |

FOREIGN PATENT DOCUMENTS

| | | | |
|---|---|---|---|
| DE | 2 825 724 | A1 | 12/1979 |
| DE | 299-02 688 | U1 | 7/1999 |
| EP | 0 337 340 | | 10/1989 |
| EP | 0 398 500 | | 11/1990 |
| EP | 0 454 586 | | 10/1991 |
| EP | 0 779 047 | B1 | 6/1997 |
| FR | 2 385 365 | | 12/1978 |
| GB | 881700 | | 11/1961 |
| GB | 2 027 339 | | 2/1980 |
| GB | 2 283 407 | A | 5/1995 |
| WO | WO 91/15141 | A | 10/1991 |

* cited by examiner

PRODUCT MANAGEMENT DISPLAY SYSTEM

FIELD OF THE INVENTION

The present invention relates generally to a shelf assembly for use in merchandising product and more particularly to a shelf assembly having improved mechanisms for displaying and pushing both wide and narrow product on the shelves.

BACKGROUND OF THE INVENTION

It is known that retail and wholesale stores, such as drug stores, grocery stores, discount stores, toy stores, and the like, require a large amount of shelving both to store product and to display the product to consumers. In displaying product, it is desirable for the product on the shelves to be situated toward the front of the shelf so that the product is visible and accessible to consumers. To accomplish this placement of product, known systems include the use of a pusher system to push the product toward the front of the shelf as the product at the front of the shelf is removed. Known systems also use dividing panels or dividers to separate product on the shelf to provide better organization of the product and to make the display of the product more appealing to consumers. Known merchandising systems that incorporate the use of pusher mechanisms can be found in U.S. Pat. Nos. 6,041,720 and 4,830,201 and application PCT/US02/15760, all of which are assigned to RTC Industries, Inc, and are incorporated herein by reference.

In the past, to display product of varying sizes, the pusher mechanism typically needed to be modified to properly push the product. For example, if the product had a narrow width configuration, often a narrower pusher panel was used to properly push the narrower product on the shelf. Similarly, if the product had a wide width configuration, a wider pusher panel was used to push the product toward the front of the shelf. Alternatively, multiple pusher panels were used to push the wide width product. The change in pusher panel width without commensurate changes to other dimensions of the pusher mechanism caused the pusher to bind or bend and not operate smoothly. To modify the pusher mechanism from a narrow panel to a wider panel typically required store personnel to change the pusher panels or, in the case of a narrow panel, attach a wider pusher panel over the narrow panel. Alternatively, and as indicated above, with some merchandising systems a second pusher mechanism was added to push the wider product. Such modifications to the merchandising systems were often time consuming and required the use of additional components not readily accessible nearby. Also, the additional components needed to be inventoried by the stores, thereby adding additional cost to the stores. In many instances, the additional components were misplaced or lost by the stores. In addition, the store personnel who often were required to make such modifications to the pusher mechanism, were sometimes incorrectly installing parts and components, which often led to the improper functioning of the merchandising system.

The present invention is directed at overcoming these known drawbacks and disadvantages with existing pusher mechanisms used with merchandising systems.

SUMMARY OF THE INVENTION

The present invention is directed to a product management display system using a pusher mechanism having an adjustable pusher panel to accommodate both narrow and wide product without the need to add, remove, or change parts or components of the pusher mechanism or the product display system.

In accordance with an illustrative embodiment of the invention, the product management display system includes a unique pusher mechanism having an extendable pusher face. The pusher mechanism is mounted to a track that extends generally from the front of the shelf to the back of the shelf. The track is formed in a base that is, in turn, directly or indirectly mounted to a store shelf. The pusher face is transversely extendable relative the track and is extendable from a retracted position to one of several extended positions. The extended pusher face locates the product pushing surface behind the center or near the center of the wider product, thereby greatly enhancing the pushing leverage on the product.

Additional features and advantages of the invention will be apparent upon reviewing the following detailed description.

Figure 1:
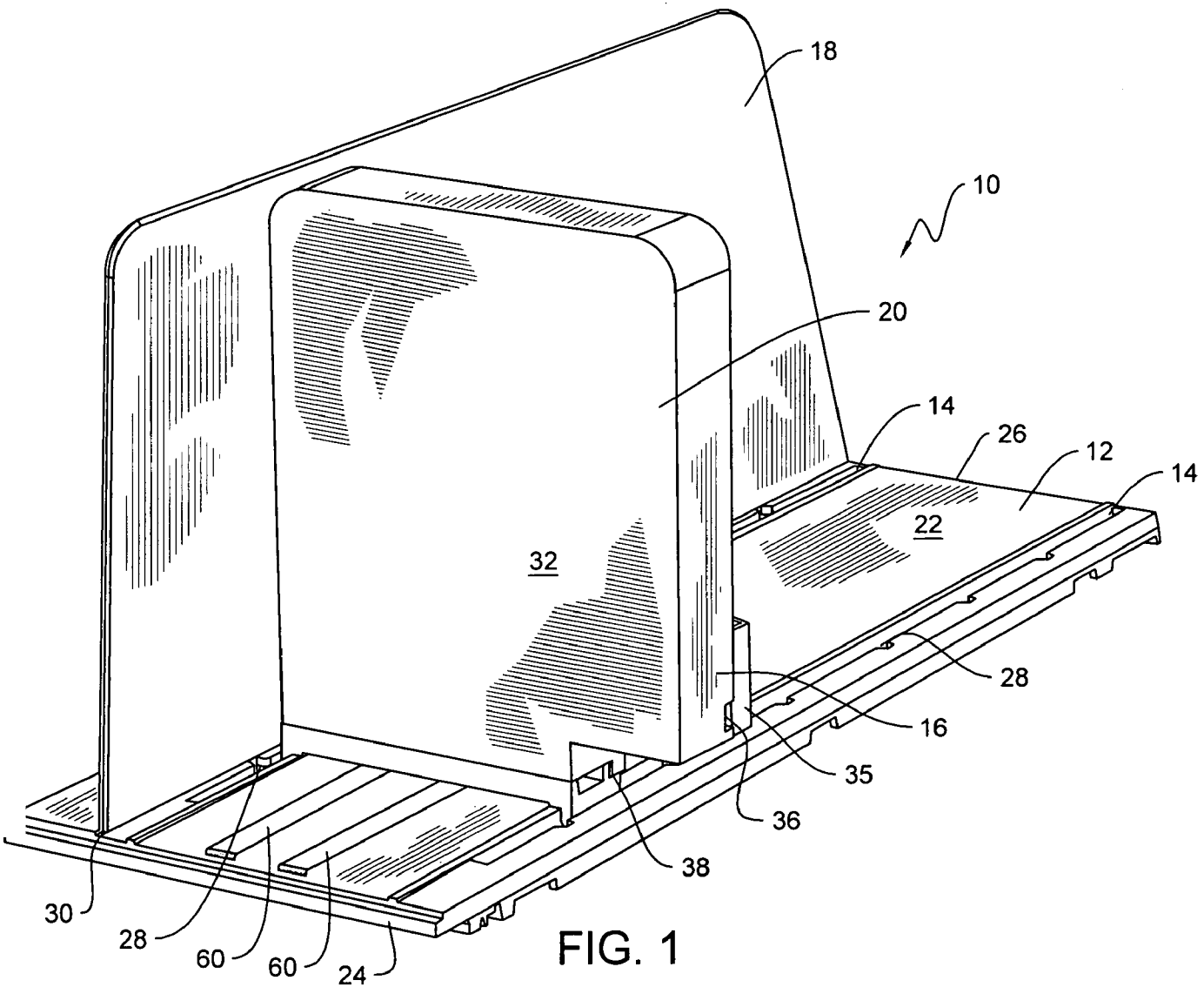
FIG. 1 depicts an isometric view of an exemplary embodiment of a product management display system of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE INVENTION

The invention may be embodied in various forms. Referring to the Figures wherein like numerals indicate like elements, there is depicted in FIG. 1 an isometric view of the present invention. The invention allows the placement and removal of merchandised product of differing width at various positions in the system with a simple operation.

Figure 2:
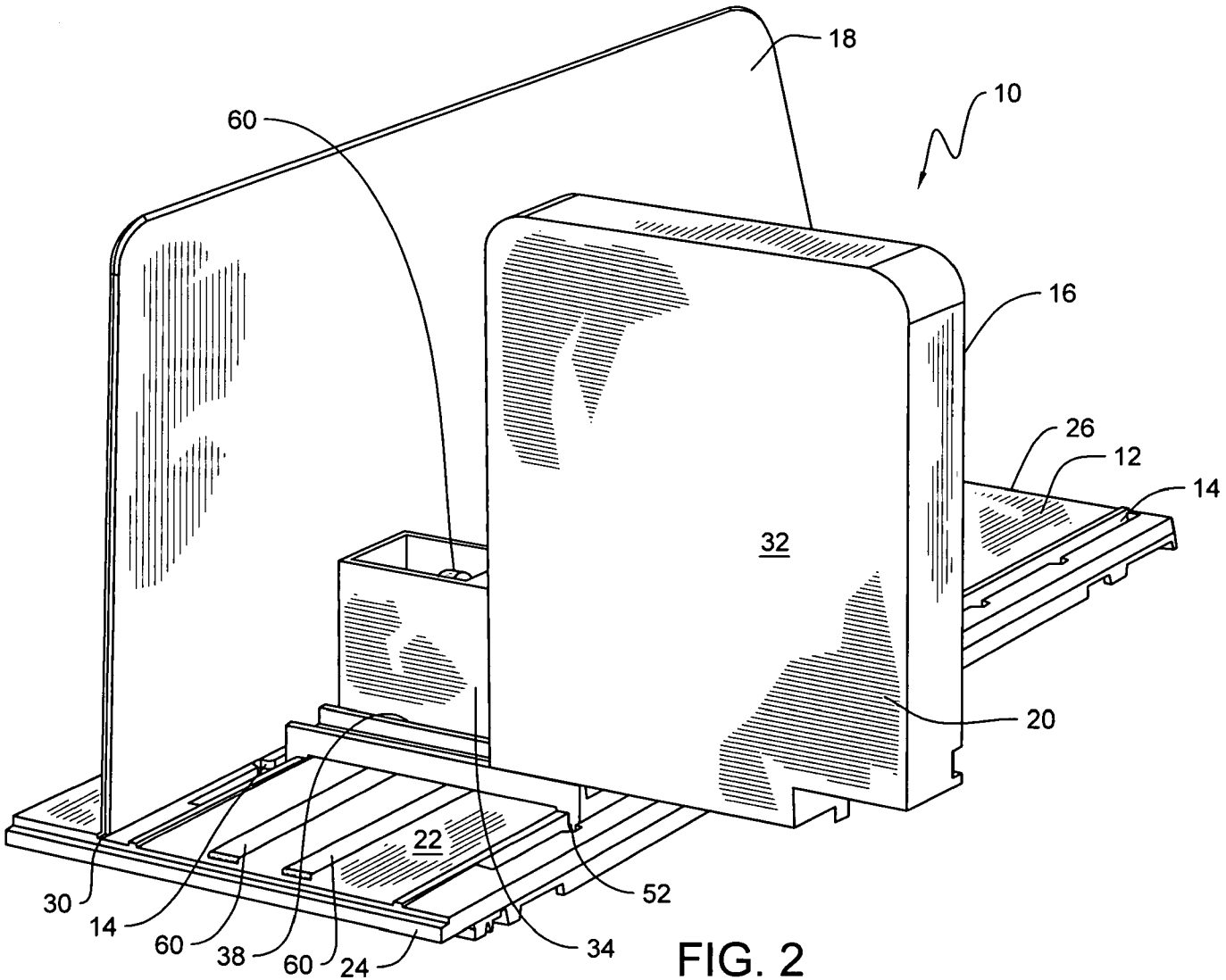
FIG. 2 depicts another isometric view of the product management display system of FIG. 1.
Figure 3:
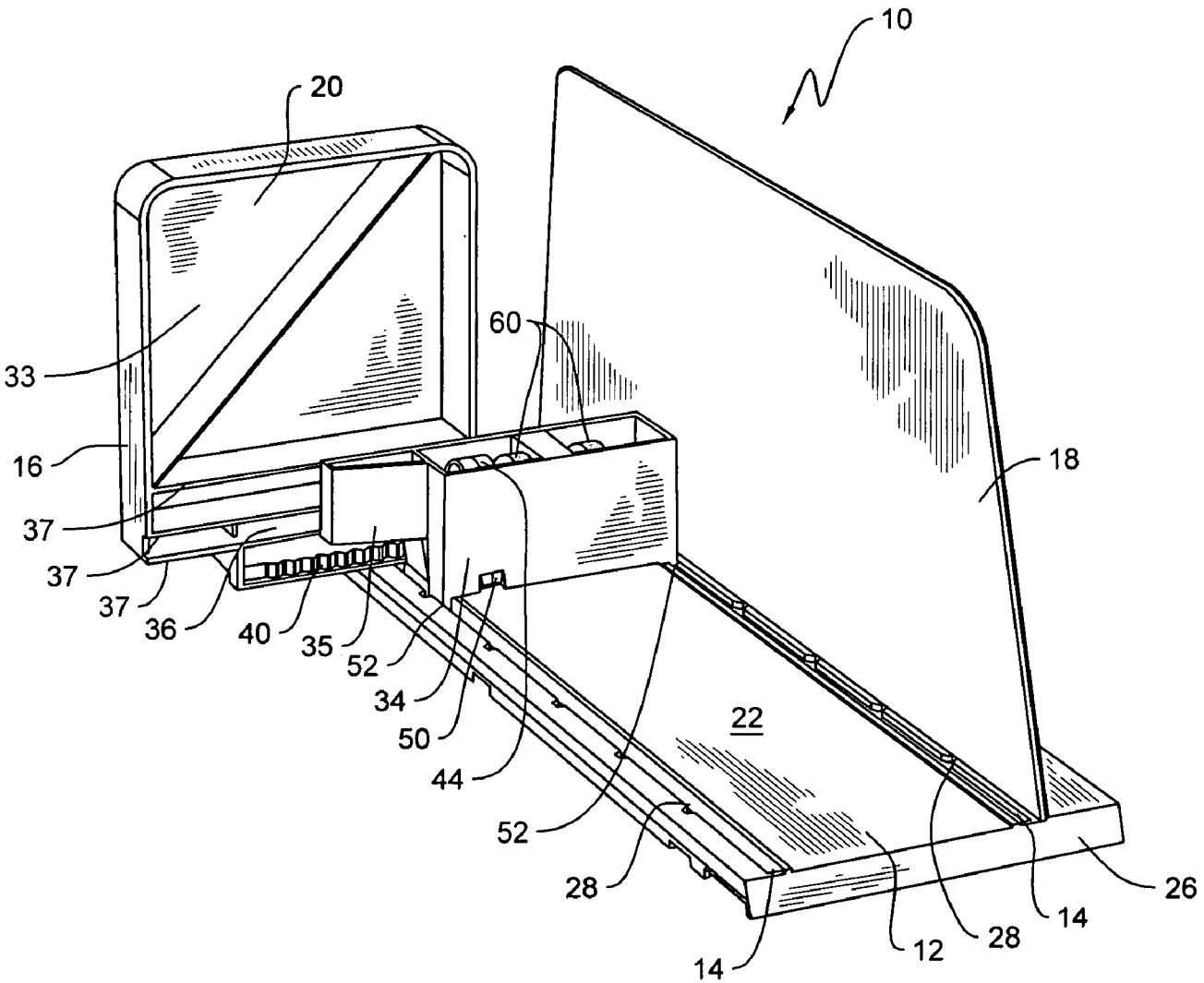
FIG. 3 depicts another isometric view of the product management display system of FIG. 1.

Referring to FIGS. 1–3, there are depicted various views of an exemplary embodiment of a product management display system 10 of the invention. The system 10 includes a base 12 defining a track 14 on which is slidably mounted a pusher mechanism 16 of the present invention. The system 10 also includes a product divider 18 that extends outwardly from the base 12 to divide and organize product on the shelf. While the system 10 is depicted as a single base 12, pusher mechanism 16, and divider 18, one of skill in the art will understand that multiples of these components are often used in stores and in various configurations. In addition, it should be understood that the system 10 may be configured such that the base 12 is mounted as a top wall or ceiling such that the pusher mechanism 16 and divider 18 would extend downwardly from the base 12. In addition, the system may be configured such that the pusher mechanism 16 is mounted to the divider 18 and would extend outwardly from the divider 18. The present invention is therefore not to be limited to the single system 10, nor the upright pusher configuration, depicted in the Figures, as the system 10 is simply illustrative of the features of the invention.

As described in more detail below, the pusher mechanism 16 of the invention includes the ability to be slidably configured to push narrow product and also wide product. The pusher mechanism 16 achieves these multiple configurations, without the use of separate, additional components by providing a pusher face 20 that can slide along the base and extend transversely relative to the track 14. This transverse movement of the pusher face 20 is best illustrated by FIGS. 1 and 2. As depicted in FIG. 1, the pusher face 20 is shown retracted toward the divider 18. In this position, the pusher face 20 will properly push narrower product and some wider product, depending on the shape, size, and configuration of the product. As depicted in FIG. 2, the pusher face 20 is shown extended away from the divider 18 or, in other words, moved transversely relative to the track 14. In this position, the pusher face 20 will be in a wide product pushing position to properly push wider product, depending on the shape, size and configuration of the product, as the pusher face 20 will now be positioned toward the center of the product. In this pusher face position, the pushing leverage of the pusher mechanism is greatly enhanced. As will be explained in greater detail below, the pusher face 20 is incrementally adjustable to numerous positions between the retracted position and the fully extended position. Advantageously, this incremental adjustment feature permits the selective adjustment of the pusher face 20 to accommodate and properly push nearly any product normally merchandised on the shelf regardless of its size, shape, and configuration. This selective adjustment permits the user to locate the pusher face 20 at or near the center of the product, or otherwise optimize the pushing leverage of the pusher mechanism on the product.

In an exemplary embodiment, the base 12 defines a generally flat planar surface 22 that may be configured to engage with or mount onto any known shelf used in a store, and in any known mounting configuration and orientation. The particular mounting of the base 22 to the shelf and orientation relative to the shelf is not pertinent to the present invention and any known mounting technique may be used to install the base 12 to the shelf. As depicted, the base 12 defines a front edge 24, a back edge 26, and track 14 extending along the base 12 from the front edge 24 to the back edge 26. As illustrated, two tracks 14 can be used with each pusher mechanism and are spaced apart to mount the pusher mechanism 16. It should be understood that more or less than two tracks could be used with the invention, depending on the particular application. The track 14 forms a groove or channel 28 in the base 12 that is sized and shaped to receive a mating flange of the pusher mechanism 16, described below. When viewed from either the front edge 24 or the back edge 26 of the base 12, the exemplary groove 28 can generally define an "L" shaped configuration. This configuration permits the flange of the pusher mechanism 16 to slidably mount to the base 12 and yet prevents the pusher mechanism 16 from lifting out of the track 14. Note that other shapes of the groove 28 are possible with the invention to mount the pusher mechanism 16 to the base 12.

Extending outwardly from the base 12 is a product divider 18. The divider 18 is used to separate merchandised product into rows on the shelves. In an exemplary embodiment, the divider 18 is slidably positioned in a slot 30 which extends across the base 12 from the front edge 24 to the back edge 26 of the base 12. The divider 18 may be a removable divider that is slidably removed from the slot 30 from either the front edge 24 or the back edge 26 of the base 12. The divider 18 may also be configured to be removed from the base 12 by lifting the divider 18 out of the slot 30. In an embodiment, the divider 18 may be formed integral with the base 12 such that it cannot slide out of or be lifted from the base 12.

It should be understood by those skilled in the art that variations to the base 12 and divider 18 can be made to accommodate the insertion, placement, or removal of the dividers, variations that are within the scope of the invention. For example, it may be desirable to reverse the structure that provides the slidable engagement of the divider 18 with the slot 30 and still achieve the slidable removal of the divider 18. In other words, it may be desirable to place a slot in the end of the divider 18 that slidably engages a guide portion located in the base 12. This construction still permits the slidable insertion and removal of the dividers onto the base 12. As another example, it should be understood that the divider 18 may be formed integral with the base 12, or snap-fit into the base 12, such that the divider 18 cannot be easily removed. Moreover, one skilled in the art will appreciate that the shape of divider 18 is not limited to shape depicted in the Figures. Rather, the divider 18 shape may define any shape, profile, or contour that enhances the placement and removal of product on the shelf.

It is contemplated that the pusher mechanism 16 may be mounted to the divider 18 in the same manner and using the same techniques described above with respect to the mounting of the pusher mechanism 16 to the base 12, or in any known mounting technique, such as the technique described in U.S. Pat. No. 4,830,201, incorporated by reference. In this configuration, the pusher mechanism 16 will slidably move across the divider 18 and between the front of the divider 18 and the back of the divider panel 18. The pusher face 20 will extend outwardly from the divider 18 and will be extendable between a narrow product pushing configuration and a wider product pushing configuration, as described herein.

As stated above, the pusher mechanism 16 of the invention includes the ability to push narrow product and to be slidably configured to multiple positions to also push wider product. The pusher mechanism 16 achieves these multiple configurations and positions by providing a pusher face 20 that can slide transversely relative to the track 14 to one of a multitude of pusher face positions.

In an exemplary embodiment, the pusher face 20, also known as a pusher paddle, extends outwardly from the base 12. The pusher face 20 can define generally a flat planar pusher surface 32 or another shape suitable to pushing specific product packages such as cylindrical products. The pusher face 20 further defines a thickness suitable for pushing wider, heavier product without experiencing undue bending. The pusher face 20 may be made of any known material, such as a plastic material, that is suitable for pushing product.

The pusher face 20 is coupled to the track 14 through the use of a pusher support base 34, as illustrated in FIG. 3. The pusher face 20 is slidably mounted to the support base 34 along a support track 36 (FIGS. 1 and 3) and a support track 38 (FIGS. 1 and 2), both of which provide a point of engagement for the pusher face and also permit the pusher face 20 to slide in a generally horizontal manner. The pusher face 20 is mounted to the support base 34 at these points of engagement to provide a secure connection of the pusher face 20 to the support base 34. One skilled in the art will appreciate that other techniques for mounting the pusher face 20 to the pusher support base 34 are possible and that the support tracks 36, 38 are simply illustrative of an exemplary embodiment.

Figure 4:
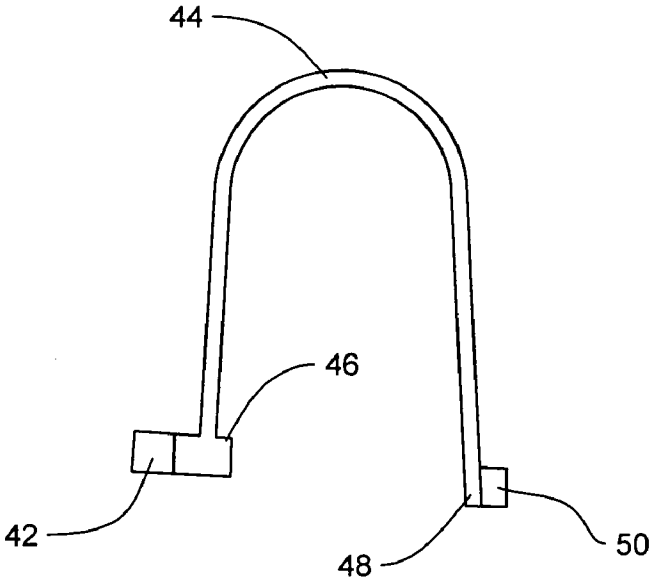
FIG. 4 depicts a top plan view of an exemplary biasing element used with the product management display system of FIG. 1.
Figure 5:
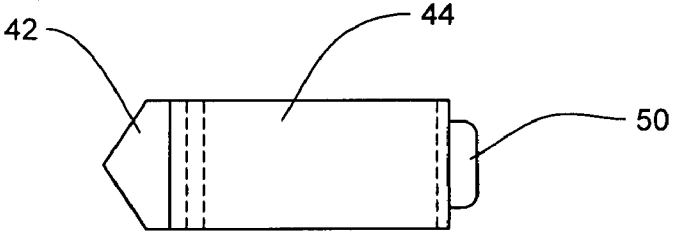
FIG. 5 depicts a side elevation view of the exemplary biasing element of FIG. 4.

In an exemplary embodiment, and depicted in FIGS. 3–5, located along the back side 33 of the pusher face 20 are a plurality of detents 40 that engage with a biased extension 42 mounted to the support base 34. The biased extension 42 and the detents 40 permit the incremental movement of the pusher face 20 and serve to hold the pusher face 20 in a desired position after the pusher face 20 is slid relative to the support base 34 and therefore relative to the tracks 14. In other words, as the pusher face 20 is slid along the support tracks 36, 38 of the support base 34, the biased extension 42 moves across the plurality of detents 40 seating and re-seating in the plurality of detents 40 until the pusher face 20 is at the desired position. Once at the desired position, the biased extension 42 will seat in the detent 40 and hold the pusher face 20 in that position.

As illustrated in FIGS. 4–5, the biased extension 42 is part of a U-shaped biasing element or spring 44 that is mounted to the support base 34. The U-shaped spring 44 defines at end 46 the biased extension 42, and at end 48 a mounting flange 50 used to secure the U-shaped spring 44 to the support base 34. As installed, the U-shaped spring 44 provides a biasing force to urge the biased extension 42 onto the detents 40. As depicted, the biased extension 42 defines a shape that matches the shape of the detents 40 to provide a proper mating engagement of the biased extension 42 with the detents 40.

The pusher face 20 is slidably mounted to the support base 34, as described above, to slide transversely relative to the tracks 14. The slidable adjustment of the pusher face 20 permits the user to extend the pusher face 20 from a retracted position, as depicted in FIG. 1, to one of several extended positions, as depicted in FIG. 2, preferably a position that ensures the pusher face 20 is aligned with the center of the product (or any other desirable position) to properly push the product. This selective adjustment of the pusher face 20 to the center of the product (or any other desirable position) greatly enhances the pushing leverage of the pusher face 20 on the product, without the user having to change out the pusher face, add an additional track, widen the spacing between the tracks 14, or add a second pusher mechanism or other components.

As stated, the pusher face 20 will be held in the desired pusher face location by the biased extension 42 and the detents 40. One of skill in the art will understand that other variations to the described technique of holding the pusher face 20 in any of the transversely extended positions are possible and are considered within the scope of the invention including, without limitation, techniques using pins, clips, fasteners, springs, clamps, or other securement and attachment techniques known in the art. In addition, it is contemplated that the present invention may be used without the holding techniques described herein; rather, the pusher face may be slidably extended through any known techniques and held in place by friction alone. Moreover, one skilled in the art will understand that other techniques to transversely extend the pusher face to a wide product pushing configuration are possible, including the use of different track 36, 38 configurations, tongue and groove techniques, and the like. In addition, it is contemplated that the pusher face 20 may incorporate a pusher face extension that extends transversely outward from the pusher face 20 to provide a wider pushing surface. The pusher face extension may be incorporated onto the pusher face 20 through the use of any technique described herein.

The support base 34 defines outwardly extending flanges 52 used to slidably mount and secure the support base 34 to one or more tracks 14. The support base 34 defines a sufficient width and depth to provide the pusher face 20 with a support foundation that will allow the pusher face 20 to properly push wider and often heavier product on the shelf without the undesirable binding of the flanges 52 in the tracks. Also, in an exemplary embodiment, the outwardly extending flanges 52 are spaced apart on the support base 34 and therefore spaced apart in the tracks 14 to provide a support foundation that will prevent bending or tipping of the pusher face 20 as it pushes the wider and often heavier product. One of skill in the art will appreciate that the number, positioning and spacing of the flanges 52 will vary depending on the desired application and the size of the product being pushed. Therefore, it will be readily understood that the present invention is not limited to the number, spacing and positioning of the flanges 52 illustrated by the exemplary embodiment depicted in the Figures.

The support base 34 also defines a base extension 35 that serves as a support structure for the mounted pusher face 20. The base extension 35 is depicted as protruding outwardly from the support base 34 and across the back side 33 of the pusher face 20 and along pusher face support ribs 37. The base extension 35 will provide support for the pusher face 20 in the retracted position, or in any of the extended positions. The base extension 35 may be formed integral with the support base 34 or may be attached to the support base 34 using known attaching techniques.

The support base 34 also serves to contain at least one pusher urging element 60 used to urge the pusher face 20 toward the front of the shelf. The pusher urging element 60 may be any biasing element including, without limitation, a flat coil spring commonly used with pusher systems. The present invention may use one or more pusher urging elements 60 to urge the pusher face 20 depending on the desired application. The pusher urging element 60 may be mounted to the pusher mechanism 16 and the base 12 using any known mounting technique. In the exemplary embodiment, one end of the pusher urging element 60 is secured to the base 12 near the front edge 24 of the base 12, and the opposing end of the pusher urging element 60, which is depicted as a coiled end, is positioned behind the pusher mechanism 16 to urge the pusher face 20 toward the front of the shelf, as known in the art.

Other mounting configurations of the pusher urging element 60 are possible with the present invention. In other words, the fixed end of the pusher urging element 60 may be mounted to the pusher mechanism 16, while the other coiled end may be operatively mounted to the base or other structure.

In addition, other techniques for mounting the pusher urging element 60 to the base 12, the pusher mechanism 16, or other components are possible with the present invention, including the unique mounting technique shown and described in published application PCT/IB03/01088, assigned to RTC Industries, Inc., and incorporated herein by reference. With that mounting technique, the end of the pusher urging element defines a V-shape and has a predetermined spring resiliency such that under an applied load the V-shaped end will compress and will return to its original shape upon the removal of the applied load. During installation, the V-shaped end will be pressed into a channel formed in the base and will compress as the end passes into the channel. Once in the channel, the V-shaped end will release and will snap fit into the channel, thereby securing the pusher urging element to the base. To release the pusher urging element from the channel, one must simply press on the V-shaped end until the V-shaped end passes back through the channel. The pusher urging element may then be lifted up and out of the channel. For more detail concerning this unique mounting technique, reference should be made to published application PCT/IB03/01088.

Variations and modifications of the foregoing are within the scope of the present invention. It should be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A product management display system, comprising:

a base for operative coupling to a shelf, a divider for dividing displayed merchandise into rows, wherein the divider extends outwardly from the base, and a pusher, the pusher movable in a first direction, the pusher including a pusher face that is extendable horizontally in a second direction from a first position to a second position.

2. The product management display system of claim 1, wherein the pusher face is extendable in the second direction from the first position to one of a plurality of second positions.

3. The product management display system of claim 1, wherein the pusher face is extendable in a second direction that is substantially perpendicular to the first direction.

4. The product management display system of claim 1, wherein the pusher face is mounted to a pusher base.

5. The product management display system of claim 4, wherein the pusher base includes at least one flange for mounting the pusher base to the base.

6. The product management display system of claim 5, wherein the base includes at least one track, the flange of the pusher base is mountable to the at least one track.

7. The product management display system of claim 4, wherein the pusher base is operatively coupled to a pusher urging element.

8. The product management display system of claim 1, wherein the pusher is coupled to the divider.

9. The product management display system of claim 4, wherein the pusher face includes a plurality of detents, and the pusher base includes a biasing element that operatively engages the plurality of detents to permit the selective extension of the pusher face.

10. The product management display system of claim 9, wherein the biasing element is a U-shaped spring that defines a biased extension that operatively engages the plurality of detents.

11. The product management display system of claim 1, wherein the pusher face is incrementally extendable in the second direction.

12. The product management display system of claim 1, wherein the pusher face in the first position is located adjacent the divider, and in the second position is located away from the divider.

13. A product management display system, comprising:

a base for operative coupling to a shelf, the base including at least one track, a divider for dividing displayed merchandise into rows, and a pusher mounted to the track of the base, the pusher movable along the track, the pusher including a pusher face that is extendable outwardly across the track from a first position to a second position.

14. The product management display system of claim 13, wherein the pusher face is extendable from the first position to one of a plurality of second positions.

15. The product management display system of claim 14, wherein the pusher face is extendable in a direction that is substantially perpendicular to the divider.

16. The product management display system of claim 13, wherein the pusher face is mounted to a pusher base.

17. The product management display system of claim 16, wherein the pusher base includes at least one flange for mounting the pusher base to the base.

18. The product management display system of claim 17, wherein the flange of the pusher base is mountable to the at least one track.

19. The product management display system of claim 18, wherein the pusher base is operatively coupled to a pusher urging element.

20. The product management display system of claim 19, wherein the pusher urging element is a coiled spring.

21. The product management display system of claim 20, wherein the pusher face includes a plurality of detents, and the pusher base includes a biasing element that operatively engages the plurality of detents to permit the selective extension of the pusher face.

22. The product management display system of claim 21, wherein the biasing element is a U-shaped spring that defines a biased extension that operatively engages the plurality of detents.

23. The product management display system of claim 13, wherein the pusher face is incrementally extendable from the first position to the second position.

24. The product management display system of claim 13, wherein the pusher face in the first position is located adjacent the divider, and in the second position is located away from the divider.

25. A product management display system, comprising:

a base for operative coupling to a shelf, the base including at least one track, a divider for dividing displayed merchandise into rows, and a pusher operatively coupled to the track of the base, the pusher movable along the track, the pusher including a pusher face that is movable along the track and is slidably configured to extend substantially horizontally perpendicular to the track.

26. The product management display system of claim 25, wherein the pusher face is extendable from a first position to one of a plurality of second positions.

27. The product management display system of claim 26, wherein the pusher face is incrementally extendable from the first position to one of the plurality of second positions.

28. The product management display system of claim 25, wherein the pusher face is mounted to a pusher base.

29. The product management display system of claim 28, wherein the pusher base includes at least one flange for mounting the pusher base to the base.

30. The product management display system of claim 29, wherein the flange of the pusher base is mountable to the at least one track.

31. The product management display system of claim 30, wherein the pusher base is operatively coupled to a pusher urging element.

32. The product management display system of claim 31, wherein the pusher urging element is a coiled spring.

33. The product management display system of claim 28, wherein the pusher face includes a plurality of detents, and the pusher base includes a biasing element that operatively engages the plurality of detents to permit the selective extension of the pusher face.

34. The product management display system of claim 33, wherein the biasing element is a U-shaped spring that defines a biased extension that operatively engages the plurality of detents.

35. The product management display system of claim 26, wherein the pusher face in the first position is located adjacent the divider, and in the one of the plurality of second positions is located away from the divider.

36. A product management display system, comprising:

a base for operative coupling to a shelf, the base including at least one track, a divider for dividing displayed merchandise into rows, and a pusher operatively coupled to the track of the base, the pusher movable along the track, the pusher including a pusher base and a pusher face mounted to the pusher base, the pusher base includes at least one flange for mounting the pusher base to the base, the pusher base is operatively coupled to a pusher urging element, the pusher face is extendable outwardly across the track from a first position to one of a plurality of second positions.

37. The product management display system of claim 36, wherein the pusher face is extendable in a direction that is substantially perpendicular to the divider.

38. The product management display system of claim 37, wherein the flange of the pusher base is mountable to the at least one track.

39. The product management display system of claim 38, wherein the pusher urging element is a coiled spring.

40. The product management display system of claim 39, wherein the pusher face includes a plurality of detents, and the pusher base includes a biasing element that operatively engages the plurality of detents to permit the selective extension of the pusher face.

41. The product management display system of claim 40, wherein the biasing element is a U-shaped spring that defines a biased extension that operatively engages the plurality of detents.

42. The product management display system of claim 41, wherein the pusher face is incrementally extendable from the first position to the one of the plurality of second positions.

43. The product management display system of claim 42, wherein the pusher face in the first position is located adjacent the divider, and in the one of the plurality of second positions is located away from the divider.

* * * * *